United States Patent [19]

Aizawa et al.

[11] Patent Number: 4,895,792

[45] Date of Patent: Jan. 23, 1990

[54] PHOTOGRAPHIC LIGHT-SENSITIVE SILVER HALIDE ELEMENT WITH ANTISTATIC BACKING LAYER

[75] Inventors: Yasuhiro Aizawa; Touru Noda, both of Tokyo, Japan

[73] Assignee: Mitsubishi Paper Mills, Ltd., Tokyo, Japan

[21] Appl. No.: 273,156

[22] Filed: Nov. 18, 1988

Related U.S. Application Data

[63] Continuation of Ser. No. 25,590, Mar. 13, 1987, abandoned.

[30] Foreign Application Priority Data

Mar. 17, 1986 [JP] Japan ..... 61-59779

[51] Int. Cl.[4] ..... G03C 1/82

[52] U.S. Cl. ..... 430/530; 430/523; 430/527

[58] Field of Search ..... 427/922; 430/527, 530, 430/523

[56] References Cited

U.S. PATENT DOCUMENTS

| | | | |
|---|---|---|---|
| 3,007,878 | 11/1961 | Alexander et al. . | |
| 3,053,662 | 9/1962 | Mackey et al. . | |
| 3,884,692 | 5/1975 | Minagawa . | |
| 4,418,141 | 11/1983 | Kawaguchi et al. | 430/527 |
| 4,544,622 | 10/1985 | Kausch | 430/527 |

OTHER PUBLICATIONS

"Snowtex Colloidal Silica" by Nissan Chemical Industries, Ltd.

*Primary Examiner*—Jack P. Brammer

*Attorney, Agent, or Firm*—Cushman, Darby & Cushman

[57] ABSTRACT

Photographic light-sensitive materials having a coating layer containing a cation modified colloidal silica on one surface of a hydrophobic support have markedly improved antistatic properties.

5 Claims, No Drawings

PHOTOGRAPHIC LIGHT-SENSITIVE SILVER HALIDE ELEMENT WITH ANTISTATIC BACKING LAYER

This is a continuation of application Ser. No. 025,590, filed Mar. 13, 1987, which was abandoned upon the filing hereof.

BACKGROUND OF THE INVENTION

This invention relates to a photographic light-sensitive material and more particularly it relates to a photographic light-sensitive material improved in antistatic properties without giving adverse effect on the photographic characteristics.

In general, photographic light-sensitive materials comprise a support having electrical insulation properties and a photographic light-sensitive layer and so they are apt to undergo friction or separation due to contact with similar or different materials during preparation or use of them to cause formation of static charges resulting in adsorption of foreign matters or dusts. The static charges may further cause various troubles such as repellency, desensitization, peeling, etc. Besides, when the static accumulated is discharged, there often occurs the significant defect of photographic characteristics called static markings on the light-sensitive emulsion layer. An attempt has been made to overcome this problem by providing antistatic back coating layer which can dissipate the static charges onto the electrically insulating surface.

Thus, various materials have been employed in order to prevent static build-up of photographic light-sensitive materials. These materials include ionic conductive materials or hygroscopic materials. A generally employed method has been to impart conductivity to light-sensitive materials, thereby to make rapid dissipation of the electric charges prior to discharge caused by accumulation of charges. In order to impart antistatic properties directly to a support of photographic light-sensitive materials, it has been known to directly incorporate these materials into a polymeric material which constitutes the support or to coat them on the surface of the support. For the latter method, the materials are coated as a mixture with polymeric materials such as gelatin, polyvinyl alcohol, cellulose acetates, etc. in order to improve retention of especially antistatic agents The antistatic agent may be added to a light-sensitive emulsion layer provided on a support, but may also be added to other non-light-sensitive auxiliary layers (for example, back coating layer, antihalation layer, intermediate layer, protective layer, etc.)

Most of the conventional antistatic agents do not have satisfactory effects in light-sensitive materials having an emulsion layer of high sensitivity, especially under low humidity or they are deteriorated in their characteristics with time or cause troubles in adhesion under high temperature and high humidity conditions. Furthermore, antistatic agent in non-light-sensitive auxiliary layers sometimes acts on the contiguous light-sensitive emulsion layer especially under high temperature and high humidity to cause deterioration of photographic characteristics such as increase of fog density and obstruction of development.

SUMMARY OF THE INVENTION

The object of this invention is to provide a photographic light-sensitive material which has a low surface resistivity, is not adversely affected in its photographic characteristics, has antistatic properties which are not damaged by,temperature and humidity during storage of long period, has a strong film properties and does not deteriorate developer and fixer.

According to this invention, there is provided a photographic light-sensitive material wherein a coating layer containing a cation modified colloidal silica is provided on one side of a photographic hydrophobic support which is opposite to the side on which a light-sensitive emulsion layer is present, namely, on the side of the support on which no emulsion layer is present.

DESCRIPTION OF THE PREFERRED EMBODIMENTS

Basic methods for preparation of cation modified colloidal silica used in this invention are disclosed in U.S. Pat. No. 3,007,878, etc. This comprises a colloidal silica the surface of which is covered with finely-divided hydrous metallic oxide. As the cation modifiers, there may be used, for example, basic metal salts such as hydrous aluminum oxide, hydrous zirconium oxide, hydrous tin oxide, etc. and colloidal silica modified with hydrous aluminum oxide exhibits especially preferred characteristics.

Covering amount of said basic metal salt on the cation modified colloidal silica of the present invention for silica (in terms of $SiO_2$) is preferably 0.5–30% by weight, more preferably 5–30% by weight in terms of metal oxide. When the covering amount of the cation modifier is small, only the characteristics of the original silica can be obtained and when it is too large, photographic characteristics are deteriorated. Especially preferred is 5–20% by weight.

Average particle diameter of the cation modified colloidal silica of the present invention may be within such range as can maintain stable characteristics, but especially preferred is 7–30 mμ.

The cation modified colloidal silica of the present invention may be used alone or in combination of two or more.

Coating amount (solid content) of the colloidal silica is preferably 30–200 mg/m$^2$. In this case, it is especially preferred that the coverage of the cation modifier for silica is 5-30% by weight in terms of metal oxide.

Furthermore, for the purpose of improvement in various characteristics such as surface slip, wrighting property, stability of coating solution, coating property, color tone, etc., various high molecular compounds, matting agents such as silica, etc., surfactants which prevent agglomeration of the solution, dyes, fluorescent whitener, etc. may be added to the coating solution containing the cation modified colloidal silica. It is especially preferred that the coating solution contains an alkali metal salt of styrene-maleic anhydride copolymer as a binder, especially in an amount of 10–100% by weight (solid content) of the cation modified colloidal silica.

As the hydrophobic supports, there may be used various supports, for example, synthetic papers such as polypropylene and polystyrene, films such as cellulose acetate, polyethylene terephthalate, polyvinyl acetate, polystyrene and polycarbonate, resin coated papers comprising a paper as a substrate coated on both sides with film forming resins such as polyolefin, polyvinyl chloride, etc., preferably polyolefin resins. As a support for photographic papers, especially color photographic papers which require good typewriter printability and antistaining property, polyolefin resin coated papers may be advantageously used because they provide especially remarkable effects of this invention.

The resin layer of these thermoplastic resin films or resin coated papers may preferably contain, in suitable combination, various additives, for instance, white pigments such as titanium oxide, zinc oxide, talc, calcium carbonate, etc., dispersants, for example, fatty amides such as stearamide, etc., metallic salts of fatty acids such as zinc stearate, magnesium stearate, etc., pigments and dyes such as ultramarine blue, cobalt violet, etc., antioxidant, fluorescent whiteners, ultraviolet absorbers.

The polyolefin resin coated papers which are advantageously used in this invention are prepared by extrusion coating on a running substrate paper a molten polyolefin resin in the form of film from a slit die. In this case, it is preferred to activate the surface of the substrate paper by corona discharge treatment, flame treatment, etc. prior to the melt extrusion coating. Thickness of the resin coat layer has no special limitation, but preferably is about 5–50 $\mu$. The side of the polyolefin resin coated paper on which silver halide photographic layers are provided may have a gloss surface, matte surface, silk-like surface, etc. and the back side usually has a dull surface.

Polyolefin resins used for preparation of polyolefin resin coated paper advantageous for practice of this invention include homopolymers of olefins such as low-density polyethylene, high-density polyethylene, polypropylene, etc., copolymers of two or more olefins such as ethylene-propylene copolymer, etc. or mixtures thereof. These resins may be used alone or in admixture of those of various densities and melt viscosity indexes (melt index: referred to as merely "MI" hereinafter).

As substrate papers for polyolefin resin coated papers, there may be used any of normal natural pulp papers, synthetic fiber papers and so-called synthetic papers which are simulated papers made from synthetic resin films, but preferred are natural pulp papers mainly composed of wood pulp such as soft wood pulp, hard wood pulp and mixed pulp of soft wood and hard wood. Thickness of the substrate paper has no special limitation, but the surface is preferably smooth and the basis weight is preferably 50 g/m$^2$–250 g/m$^2$. Substrate papers mainly composed of natural pulp may contain various high molecular compounds and additives. For example, they may contain, in optional combination, dry-strength increasing agents such as starch derivatives, polyacrylamide, polyvinyl alcohol derivatives, gelatin, etc.; sizing agents such as fatty acid salts, rosin derivatives, dialkylketene dimer emulsion, etc.; wet-strength increasing agents such as melamine resins, urea resins, epoxidized polyamide resins, etc.; stabilizers; pigments; dyes; fluorescent whiteners; latexes; inorganic electrolytes; pH regulators, etc.

As devices for coating a back coating solution onto the hydrophobic surface of the support which is opposite to the side on which an emulsion layer is provided, there may be used air-knife coater, roll coater, bar coater, blade coater, slide hopper coater, gravure coater, flexogravure coater and combination of these coaters, Preferably, the hydrophobic surface of the support is activated by corona discharge treatment, flame treatment, etc. prior to coating. Thus coated layer may be dried by various drying apparatuses such as hot-air drying apparatuses such as linear tunnel dryer, arch dryer, air loop dryer, sine curve air float dryer, infrared dryer, heating dryer, dryers using microwave, etc.

As examples of light-sensitive emulsion layers used in this invention, mention may be made of enlarging positive emulsion layer, contact positive emulsion layer, negative emulsion layer, color photographic emulsion layer, printing emulsion layer, direct positive emulsion layer, diffusion transfer emulsion layer, etc.

These emulsion layers may contain binders such as gelatin, gelatin derivatives, etc., chemical sensitizers such as hypo, etc., noble metal sensitizers such as gold salts, platinum salts, etc., contrast increasing agents such as hexahalogenoiridium (III) complex, hexahalogenorhodium (III) complex, etc., nucleic acid decomposition products, crystal habit regulators for silver halide grains such as mercapto heterocyclic compounds disclosed in Japanese Patent Unexamined Publication Nos. 147925/75 and 107129/76, color sensitizers as disclosed in Japanese Patent Unexamined Patent Publication Nos. 65432/77 and 88340/77, stabilizers, antifoggants, couplers for color photography, hardeners, dihydroxybenzene compounds, coating aids, additives for direct positive emulsion such as fogging agents, dyes for direct positive photographic dyes, color developers, etc.

The photographic light-sensitive materials of this invention are subjected to treatments such as exposure, development, stopping, fixation, bleaching, stabilization, etc. as disclosed in Goro Miyamoto, "Photographic Light Sensitive Materials and Method of Treatment" (Photographic Technique Course 2, Kyoritsu Shuppan Co.). Especially, multi-layer silver halide color photographic materials which are subjected to combined bleaching and fixing treatments after color development may be processed with color developing solutions containing any developing agents, for example, CD-III and CD-IV (trade names for Kodak Company), Droxychrome (trade name for May and Baker Co.). Developing solutions containing such developing agents may contain benzyl alcohol, thallium salts, phenidone, etc. Useful combined bleaching and fixing solutions are solutions of metallic salts of aminopolycarboxylic acid (e.g., ferric complex salts of ethylenediaminetetraacetic acid, propylenediaminetetraacetic acid, etc.) and sodium thiosulfate, ammonium thiosulfate and the like are useful as fixing agents. These combined bleaching and fixing solutions may contain various additives. For example, there may be added, in combination, silver removal accelerating agents (e.g., mercaptocarboxylic acid disclosed in U.S. Pat. No. 3,512,979, mercapto-heterocyclic compounds disclosed in Belgian Patent 682,426), anti-staining agents, pH regulators or pH buffers, hardeners (e.g., magnesium sulfate, aluminum sulfate, potash alum, etc.), surfactants, etc. These combined bleaching and fixing solutions may be used at various pH, but useful pH region is 6.0-8.0.

This invention will be explained in more detail by the following examples, wherein parts and percents are all by weight unless otherwise notified.

EXAMPLES 1-5 and COMPARATIVE EXAMPLES 1-4

A paper of 160 g/m$^2$ in basis weight was run at 80 m/min. In the first zone, surface of the back side of the paper was subjected to corona discharge treatment and then on thus treated surface was melt extrusion coated a resin composition comprising 50 parts of a low-density polyethylene (density: 0.918, MI=5) and 50 parts of a high-density polyethylene (density: 0.965, MI=7) at a thickness of 30 μm by a melt extruder to form a resin layer of dull surface. In the second zone, surface of the face side of this paper was subjected to corona discharge treatment and thereon was melt extrusion coated a resin composition comprising 30 parts of a master batch of a low-density polyethylene (density: 0.918, MI=8.5) into which 30% of titanium oxide was incorporated, 45 parts of a low-density polyethylene (density: 0.918, MI=5.0) and 25 parts of a high-density polyethylene (density: 0.965, MI=7.0) at a thickness of 30 μm by a melt extruder to form a resin layer of gloss surface. In the third zone, the resin surface of the back side was subjected to corona discharge treatment and then onto thus treated surface was transferred the coating solution indicated in Table 1 by a rotating gravure roll of 140 meshes dipped in the coating solution with maintaining the coating solution on the roll at constant by scraping excess solution by a blade. Then, thus coated paper was dried to produce a photographic support having antistatic properties. Coating amount of the aqueous coating solution was 3 g/m$^2$ (wet content).

TABLE 1

| | Comparative Examples | | | | Examples | | | | |
|---|---|---|---|---|---|---|---|---|---|
| | 1 | 2 | 3 | 4 | 1 | 2 | 3 | 4 | 5 |
| Cation modified colloidal silica (20%) [Trade name: Snowtex AK (alumina modification) of Nissan Chemical Co. Ltd.] | 0 | 0 | 0 | 0 | 8 | 8 | 6 | 6 | 6 |
| Colloidal silica 20% solution [Trade name: Snowtex-O of Nissan Chemical Co. Ltd.] | 16 | 16 | 16 | 8 | 0 | 0 | 10 | 10 | 20 |
| 25% Aqueous solution of sodium salt of styrene-maleic anhydride copolymer [Trade name: Malon MS-25 of Daido Kogyo Co.] | 4.0 | 0 | 4.0 | 0 | 0 | 4.0 | 0 | 4.0 | 0 |
| Aluminum chloride | 0 | 0.5 | 0.5 | 0 | 0 | 0 | 0 | 0 | 0 |
| 2% Aqueous solution of sodium dodecylbenzenesulfonate | 0.1 | 0.1 | 0.1 | 0.1 | 0.1 | 0.1 | 0.1 | 0.1 | 0.1 |
| Water to make up: | 100 | 100 | 100 | 100 | 100 | 100 | 100 | 100 | 100 |

Note
1. Amount is expressed by weight proportion
2. Amount of cation modifier is 10% by weight of silica.

The surface of the face side (i.e., the surface of the support opposite to the back coating side) of these polyethylene coated papers provided with back coating layer was subjected to corona discharge treatment and then coated with, in order, a blue-sensitive gelatino silver chlorobromide emulsion layer containing a yellow coupler, an intermediate layer, a green-sensitive gelatino silver chlorobromide emulsion layer containing a magenta coupler, an ultraviolet absorbing layer containing an ultraviolet absorber, a red-sensitive gelatino silver chlorobromide emulsion layer containing a cyan coupler and a protective layer therefor by extrusion method. Then, these were dried to produce multilayer silver halide color photographic papers.

Thus obtained samples were kept in a thermohygrostat of 50° C. and 60% RH for one day and were evaluated by the following methods.

Evaluation of antistatic properties of back coating layer

For the samples before color development, surface resistivity (value after one minute from starting of measurement) when they were subjected to moisture conditioning at 20° C. and 30% RH for 3 hours was measured (this is indicated as "before development"). With reference to samples after subjected to color development by roll processor of the following processing method, surface resistivity when they were subjected to moisture conditioning at 20° C and 30% RH and further drying at 70° C for 90 seconds was measured (these are indicated as "after development" and "after drying", respectively).

Color development (30° C., 3 minutes and 30 seconds) →bleaching fixation (30° C., 1 minute and 30 seconds)→water washing (30° C., 3 minutes)→drying (45° C., 1 minute).

Evaluation of film strength of back coating layer

The photographic paper under a certain load was moved at a constant speed over a nylon scrubbing brush dipped in the developing solution in such a manner that the surface of the back coating layer contacts with tips of brush hairs and state of scratch on the surface was examined. The degree of the scratch was graded by the following criteria: A (substantially no scratches), B (a few scratches), C (fairly many scratches), D (many scratches) and E (a great number of scratches).

Results obtained are shown in Table 2.

TABLE 2

| Example No. | Antistatic properties (surface resistivity: Ω) Before development | After development | After drying | Film strength |
|---|---|---|---|---|
| comparative Example | | | | |
| 1 | $6.8 \times 10^{12}$ | $2.8 \times 10^{14}$ | $1.3 \times 10^{15}$ | D |
| 2 | $1.2 \times 10^{12}$ | $7.3 \times 10^{13}$ | $9.1 \times 10^{14}$ | D-E |
| 3 | $7.1 \times 10^{11}$ | $9.6 \times 10^{13}$ | $8.9 \times 10^{14}$ | D |
| 4 | $9.6 \times 10^{12}$ | $8.5 \times 10^{14}$ | $2.0 \times 10^{15}$ | D-E |
| Example | | | | |
| 1 | $9.4 \times 10^{8}$ | $3.9 \times 10^{10}$ | $9.4 \times 10^{10}$ | A-B |
| 2 | $2.0 \times 10^{9}$ | $7.8 \times 10^{10}$ | $2.2 \times 10^{11}$ | A |
| 3 | $6.4 \times 10^{9}$ | $2.5 \times 10^{11}$ | $1.1 \times 10^{12}$ | B |
| 4 | $9.7 \times 10^{9}$ | $4.1 \times 10^{11}$ | $2.0 \times 10^{12}$ | A |
| 5 | $8.4 \times 10^{9}$ | $5.6 \times 10^{11}$ | $2.9 \times 10^{12}$ | B |

As is clear from Table 2, the samples coated with the cation modified collodial silica of this invention exhibit excellent antistatic properties and besides have high film strength.

What is claimed is:

1. A photographic light-sensitive element having improved antistatic properties consisting essentially of a hydrophobic support, a photographic light-sensitive silver halide emulsion layer on one side of the support, and an antistatic layer on the other side of the support, wherein the antistatic layer comprises a binder and a cation modified colloidal silica having an average particle diameter of 7–30 millimicrons, the surface of the colloidal silica being coated with a cation modifier chosen from finely divided hydrous metallic oxide selected from aluminum, zirconium, and tin in an amount of 0.5%–30% weight in terms of metal oxide based on the weight of the colloidal silica, and further wherein the coating amount (solid content) of cation modified colloidal silica applied to the support to form the antistatic layer is 30–200 mg/m$^2$.

2. A photographic light-sensitive element according to claim 1, wherein the coating layer contains a surfactant which does not form agglomerate with the cation modified colloidal silica.

3. A photographic light-sensitive element according to claim 1, wherein the coating layer contains an alkali metal salt of a styrene-maleic anhydride copolymer.

4. A photographic light-sensitive element according to claim 3, wherein the content of the alkali metal salt of styrene-maleic anhydride copolymer is 10–100% by weight (solid content) of the cation modified colloidal silica.

5. A photographic light-sensitive element according to claim 1, wherein the covering amount of the cation modifier for silica (in terms of $SiO_2$) is 5–20% by weight in terms of its metal oxide.

* * * * *